US010504498B2

(12) United States Patent
Ryynänen et al.

(10) Patent No.: US 10,504,498 B2
(45) Date of Patent: Dec. 10, 2019

(54) REAL-TIME JAMMING ASSISTANCE FOR GROUPS OF MUSICIANS

(71) Applicant: Yousician Oy, Helsinki (FI)

(72) Inventors: Matti Ryynänen, Helsinki (FI); Anssi Petteri Klapuri, Espoo (FI)

(73) Assignee: YOUSICIAN OY, Helsinki (FI)

( * ) Notice: Subject to any disclaimer, the term of this patent is extended or adjusted under 35 U.S.C. 154(b) by 0 days.

(21) Appl. No.: 15/820,636

(22) Filed: Nov. 22, 2017

(65) Prior Publication Data

US 2019/0156807 A1 May 23, 2019

(51) Int. Cl.

| | |
|---|---|
| ***G10H 1/36*** | (2006.01) |
| ***G10H 1/38*** | (2006.01) |
| ***G10H 1/00*** | (2006.01) |
| ***G10H 1/40*** | (2006.01) |

(52) U.S. Cl.

CPC ..... *G10H 1/383* (2013.01); *G10H 1/0025* (2013.01); *G10H 1/368* (2013.01); *G10H 1/40* (2013.01); *G10H 2210/061* (2013.01); *G10H 2210/066* (2013.01); *G10H 2210/076* (2013.01); *G10H 2210/105* (2013.01); *G10H 2210/125* (2013.01); *G10H 2210/141* (2013.01); *G10H 2210/571* (2013.01)

(58) Field of Classification Search

CPC ..... G10H 1/383; G10H 1/0025; G10H 1/368; G10H 1/40; G10H 2210/066; G10H 2210/105; G10H 2240/175; G10H 1/0058; G10H 2240/305

USPC ..... 84/600, 610

See application file for complete search history.

(56) References Cited

U.S. PATENT DOCUMENTS

| | | | | |
|---|---|---|---|---|
| 6,482,087 | B1 * | 11/2002 | Egozy | A63F 13/12 463/42 |
| 7,297,858 | B2 * | 11/2007 | Paepcke | G10H 1/0066 84/609 |
| 7,820,902 | B2 * | 10/2010 | Furukawa | G10H 1/0058 84/609 |

(Continued)

FOREIGN PATENT DOCUMENTS

| | | |
|---|---|---|
| EP | 1274069 A2 | 1/2003 |
| EP | 3048607 A2 | 7/2016 |

OTHER PUBLICATIONS

Extended European Search Report, Application No. 18201962.0, Search Completed Jan. 28, 2019, 10 pages.

(Continued)

*Primary Examiner* — Jeffrey Donels

(74) *Attorney, Agent, or Firm* — Ziegler IP Law Group, LLC

(57) ABSTRACT

Real-time jamming is automatically assisted for musicians. A real-time audio signal is received of played music that is played by at least one person. Beat is tracked of the played music from the real-time audio signal and accordingly a time of a next beat is predicted. At least one of chords; notes; and drum sounds is recognized from the real-time audio signal and repetitions in the played music are accordingly detected. A next development is predicted in the played music, based on the detected repetitions, including at least one of chords; notes; and drum sounds that will be played next, and respective timing based on the predicted time of the next beat. A real-time output is produced based on the predicted next development in the played music.

18 Claims, 3 Drawing Sheets

(56) References Cited

U.S. PATENT DOCUMENTS

| | | | | |
|---|---|---|---|---|
| 7,985,917 | B2 | 7/2011 | Morris et al. | |
| 9,177,540 | B2 | 11/2015 | Serletic, II et al. | |
| 9,236,039 | B2 * | 1/2016 | Katto | A63F 13/211 |
| 9,305,531 | B2 * | 4/2016 | Miwa | G10H 1/0066 |
| 2003/0164084 | A1 * | 9/2003 | Redmann | G10H 1/0058 84/615 |
| 2005/0150362 | A1 * | 7/2005 | Uehara | G09B 15/00 84/645 |
| 2006/0123976 | A1 * | 6/2006 | Both | G10H 1/0058 84/600 |
| 2007/0039449 | A1 * | 2/2007 | Redmann | G10H 1/0058 84/609 |
| 2007/0223675 | A1 * | 9/2007 | Surin | H04L 12/1827 379/202.01 |
| 2007/0291958 | A1 | 12/2007 | Jehan | |
| 2008/0190271 | A1 * | 8/2008 | Taub | G10H 1/0058 84/645 |
| 2010/0017034 | A1 * | 1/2010 | Nakadai | A63H 3/28 700/258 |
| 2010/0126332 | A1 * | 5/2010 | Kobayashi | G10H 1/383 84/613 |
| 2010/0192755 | A1 | 8/2010 | Morris et al. | |
| 2011/0273978 | A1 * | 11/2011 | Murayama | H04L 12/4015 370/216 |
| 2011/0289208 | A1 * | 11/2011 | Hara | H04L 12/1827 709/224 |
| 2013/0025435 | A1 | 1/2013 | Rutledge et al. | |
| 2015/0228260 | A1 | 8/2015 | Okazaki et al. | |
| 2017/0092248 | A1 | 3/2017 | Gozzi | |
| 2017/0124898 | A1 | 5/2017 | Shaffer | |
| 2017/0263226 | A1 | 9/2017 | Silverstein | |
| 2018/0097856 | A1 * | 4/2018 | Dange | H04L 65/403 |

OTHER PUBLICATIONS

Tristan Jehan, "Creating Music by Listening" These de Doctorat Presentee au Departement de Chimie de L'Universite de Lausanne pour L'Obtention du Grade de Docteur GBP ES Sciences,, Sep. 1, 2005 (Sep. 1, 2005), 137 pages.

* cited by examiner

REAL-TIME JAMMING ASSISTANCE FOR GROUPS OF MUSICIANS

TECHNICAL FIELD

The aspects of the disclosed embodiments generally relate to real-time jamming assistance for groups of musicians. The present disclosure relates particularly, though not exclusively, to real-time analysis and presentation of suitable chords or notes or drum sounds to play along with other musicians with or without any pre-existing notation for the music that is being played along.

BACKGROUND ART

This section illustrates useful background information without admission of any technique described herein representative of the state of the art.

Numerous learning systems have been developed that analyse music that is pre-recorded or for which notes are already available. Such systems can display notes or chords for playing along at a set rhythm, often with further help of a metronome sound. Such systems are of great help for rehearsing to play pre-existing songs. However, as opposed to playing sheet music or music recorded somewhere by someone, it is possible and fun to just play along or jam in a group of two or more people. In such a jamming session, the players may simply start playing together (at same time or one by one) in a given musical style and musical key. Experienced players learn to recognise suitable patterns with which to proceed synchronised with other players without need to agree in advance and write down the notes or chords. Less experienced players typically just play a chord now and another then until they become skilled enough to begin playing along in an improvised manner without the support of sheet music.

The context of a jamming event drastically differs from that of self-exercising with help of a computer program that presents chords. First, there is no rhythm determined by a computer and often no metronome, either. The tempo may flow as the players please. Second, there are no predetermined progressions of the melody. Again, the players develop the music they play inspirationally. Absent the knowledge of what will come next, it is very difficult to play along without extensive experience. Whereas self-exercise systems may pre-analyse a song to be played, the jamming situation is incompatible with the pre-requisite requirements of such systems.

It is an object of the present disclosure to provide real-time jamming assistance to help playing music along with other musicians.

SUMMARY

According to a first example aspect of the disclosed embodiments there is provided a method comprising:

receiving a real-time audio signal of played music that is played by at least one person;

tracking beat of the played music from the real-time audio signal and accordingly predicting a time of a next beat;

recognising from the real-time audio signal at least one of chords; notes; and drum sounds and accordingly detecting repetitions in the played music;

predicting a next development in the played music, based on the detected repetitions, comprising at least one of chords; notes; and drum sounds that will be played next, and respective timing based on the estimated time of the next beat; and producing a real-time output based on the predicted next development in the played music;

wherein the method is performed automatically.

The tracking of the beat may be performed using at least one digital processor. The recognising of the at least one of chords; notes; and drum sounds and accordingly detecting repetitions in the played music may be performed using at least one digital processor. The predicting of the next development in the played music may be performed using at least one digital processor. The producing of the real-time output may be performed using at least one digital processor.

The received audio signal may combine signals representing plurality of instruments. The combining may be performed acoustically by capturing sound produced by plural instruments. Alternatively or additionally, the combining may be performed electrically by combining electric signals representing outputs of different instruments.

The receiving of the real-time audio signal of played music may be performed using a microphone. The microphone may be an internal microphone (e.g. of a device that performs the method) or an external microphone. Alternatively or additionally, the receiving of the real-time audio signal of played music may be performed using an instrument output such as a MIDI signal or string pickup. The instrument output may reproduce sound or vibration produced by an instrument and/or the instrument output may be independent of producing any sound or vibration by the instrument.

The tracking of the beat of the played music from the real-time audio signal may adapt to fluctuation of the tempo of the played music.

The tracking of the beat may comprise detecting a temporal regularity in the music. The tracking of the beat may simulate tapping the foot to the music by musicians.

The predicting of the at least one of chords; notes; and drum sounds may be performed by detecting self-similarity in the played music. Self-similarity may be calculated using analysing of the received real-time audio signal so as to extract an internal representation for the played music. The internal representation may comprise any of:

1) A sequence of feature vectors. The feature vectors may be numeric. Each feature vector may represent the musical contents of a short segment of audio. The short segment of audio may represent a frame of 10 ms to 200 ms of the audio signal. A sequence of successive frames represents longer segments of the received audio signal.

2) A sequence of high-level descriptors of the received audio signal. The high-level descriptors may comprise any one or more of chords; notes; and drum sound notes (human readable).

The internal representation may be denoted by R. T may refer to a latest frame. R(T) may refer to the internal representation for the latest frame. R(T−1) may refer to the second-latest frame. A total of N frames are buffered or kept in the memory. R(T−N+1) may refer to an oldest frame that is buffered. N may vary to cover the real-time audio signal for a period from half a minute to several days. The buffer may be maintained from one music or jamming session to another, optionally regardless whether an apparatus running the method would be shut down or software implementing the method would be closed.

A self-similarity matrix may be computed. The computation of the self-similarity matrix may comprise comparing a plurality of frames (e.g. every frame) in the memory against a plurality of other frames (e.g. every other frame). When a new frame is formed from the real-time audio signal, the matrix may be updated by comparing the frame against all the previously buffered frames. The matrix may be formed to contain similarity estimates between all pairs of the buffered frames. The similarity estimates may be calculated using a similarity metric between the internal representations R for the frames being compared. An inverse of the cosine (or Euclidean) distance between feature vectors may be used.

In an embodiment, hashing may be used to enable using longer periods of the received audio signal. For example, in the case of extremely long memory lengths N (for example several days), buffering the entire similarity matrix may be undesirable as required buffer size grows proportionally to a square of N. In this embodiment, only the internal representation itself is kept for frames that are older than a certain threshold. For those frames, hashing techniques such as locality sensitive hashing (LSH) may be used to detect a sequence of frames that matches the latest sequence of frames.

The detecting of the repetitions in the played music may comprise detecting close similarity of latest L frames to a sequence of frames that happened X seconds earlier. For example, repetition may be detected if the similarity is above a given threshold for the pair of representations R at times T and T−X, for the pair at times T−1 and T−X−1, and so forth until the pair at times T−L and T−X−L.

The predicting of the next development in the played music may comprise predicting coming frames from current time T onwards. Alternatively, the predicting of the next development in the played music may comprise predicting musical events that will happen from current time T onwards, where the musical events are described using one or more of chords; notes; and drum sounds.

The user may be allowed to select a desired musical style (such as rock, jazz, or bossa nova for example) and the predicting of the next development may be performed accordingly.

The producing of the real-time output may comprise displaying any one or more of: musical notation such as notes, chords, drum notes and/or activating given fret, instrument key or drum specific indicators. The displaying may be performed using a display screen or projector. The producing of the real-time output may comprise displaying a timeline with indication of events placed on the timeline such that the timeline comprises several rows on the screen. Current time on the timeline may be indicated to the user and any predicted musical events may be shown on the timeline. The producing of the real-time output with a visualisation may allow an amateur musician to play along with a song even though they would not know the song in advance or would not be able to predict "by ear" what should be played at a next time instant.

The producing of the real-time output may comprise visualising repeating sequences. When the latest L events indicate a repetition of a previously-seen sequence, the previously seen matching sequence(s) may be visually highlighted on the device screen.

A pre-defined library of musical patterns may be used to assist in the predicting of the next development in the played music. The library may contain any one or more musical patterns selected from a group consisting of: popular chord progressions; musical rules about note progressions; and popular drum sound patterns.

A user may be allowed to select one or more recorded songs and the recorded songs may be processed as if previously received in the real-time audio signal. Subsequently, when the user is performing in real time afterwards, the latest sequence of frames may be compared also against the internal representation formed based on the recorded songs and it may be detected if the user is performing one of the recorded songs or playing something sufficiently similar and use that song in the predicting of the next development in the played music.

By using recorded songs, the method may learn possible patterns while the user is still allowed to play with rhythm, musical key (free transposition to another key) and style of her own preference freely deviating from those of the recorded songs as in a jamming session with other musicians.

A musical key of the played music may be shown to the user. The musical key may determine a set of pitches or a scale that forms the basis for a musical composition.

The producing of a real-time output may comprise performing one or more instruments along with the played music.

According to a second example aspect of the disclosed embodiments there is provided a computer program comprising computer executable program code which when executed by at least one processor causes an apparatus at least to perform the method of the first example aspect.

According to a third example aspect of the disclosed embodiments there is provided a computer program product comprising a non-transitory computer readable medium having the computer program of the third example aspect stored thereon.

According to a fourth example aspect of the disclosed embodiments there is provided an apparatus configured to perform the method of the first example aspect. The apparatus may comprise a processor and the computer program of the second example aspect configured to cause the apparatus to perform, on executing the computer program, the method of the first example aspect.

According to a fifth example aspect of the disclosed embodiments there is provided an apparatus comprising means for performing the method of the first example aspect.

Any foregoing memory medium may comprise a digital data storage such as a data disc or diskette, optical storage, magnetic storage, or opto-magnetic storage. The memory medium may be formed into a device without other substantial functions than storing memory or it may be formed as part of a device with other functions, including but not limited to a memory of a computer, a chip set, and a sub assembly of an electronic device.

Different non-binding example aspects and embodiments of the present invention have been illustrated in the foregoing. The embodiments in the foregoing are used merely to explain selected aspects or steps that may be utilised in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

Some example embodiments of the present disclosure will be described with reference to the accompanying drawings, in which.

DETAILED DESCRIPTION

In the following description, like reference signs denote like elements or steps.

Figure 1:
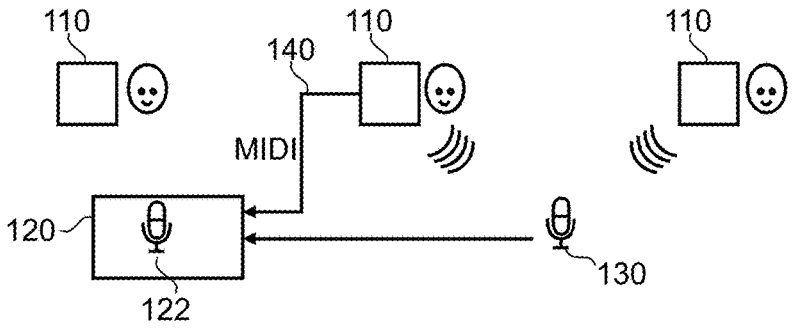
FIG. 1 shows a schematic picture of a system according to an embodiment of the present disclosure.
Figure 5:
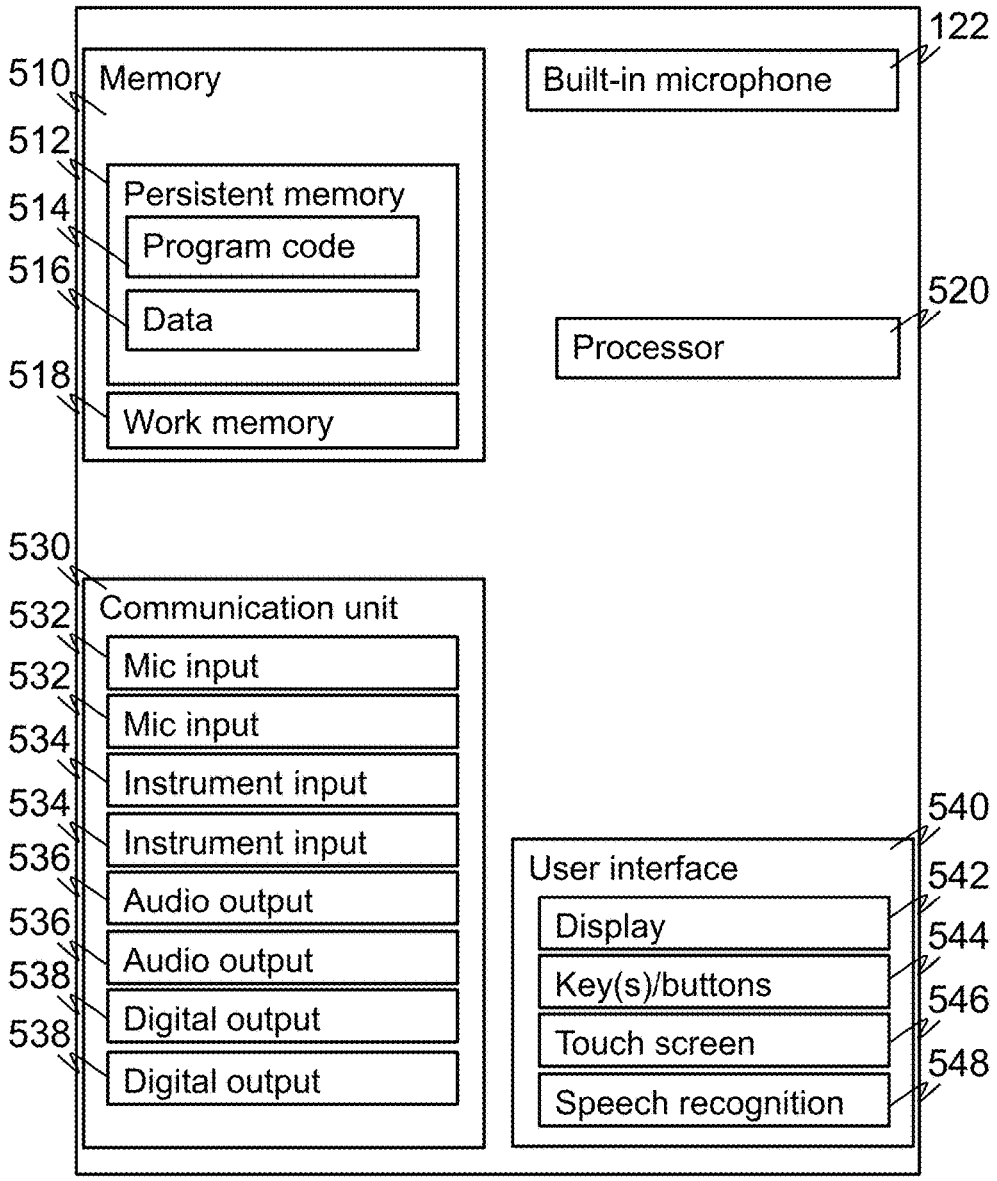
FIG. 5 shows a block diagram of a jamming assistant according to an embodiment of the present disclosure.

FIG. 1 shows a schematic picture of a system 100 according to an embodiment of the invention. The system shows three musical instruments 110 played by respective persons, a jamming assistant (device) 120, an external microphone 130 for capturing sound of two of the instruments and a midi connection 140 from one instrument 110 to the jamming assistant 120. The jamming assistant 120 further comprises an internal microphone 122 as shown in FIG. 5. In an embodiment, the jamming assistant 120 is implemented by software running in a tablet computer, mobile phone or laptop computer for portability or a desktop computer.

Figure 2:
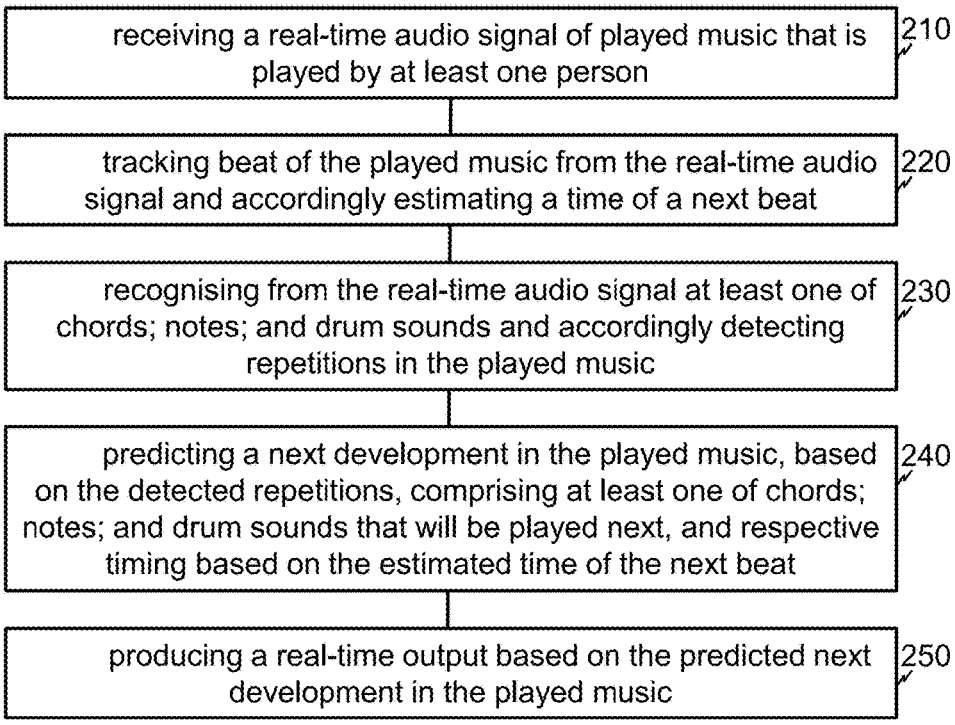
FIG. 2 shows a flow chart of a method according to an example embodiment.

FIG. 2 shows a flow chart of a method according to an example embodiment e.g. run by the jamming assistant 120. The method comprises:

receiving 210 a real-time audio signal of played music that is played by at least one person;

tracking beat 220 of the played music from the real-time audio signal and accordingly estimating a time of a next beat;

recognising 230 from the real-time audio signal at least one of chords; notes; and drum sounds and accordingly detecting repetitions in the played music;

predicting 240 a next development in the played music, based on the detected repetitions, comprising at least one of chords; notes; and drum sounds that will be played next, and respective timing based on the estimated time of the next beat; and producing 250 a real-time output based on the predicted next development in the played music.

In an embodiment, signals of a plurality of the instruments 110 are combined to the received audio signal. The combining is performed e.g. acoustically by capturing with one microphone sound produced by plural instruments 110 and/or electrically by combining electric signals representing outputs of different instruments 120.

The real-time audio signal of the played music is received e.g. using the internal microphone 122, external microphone 130 and/or an instrument input such as MIDI or electric guitar input.

The tracking 220 adapts, in an embodiment, to fluctuation of the tempo of the played music.

In an embodiment, the tracking of the beat comprises detecting a temporal regularity in the music. The tracking of the beat may simulate tapping the foot to the music by musicians.

The predicting of the at least one of chords; notes; and drum sounds can be performed by detecting self-similarity in the played music. Certain chord/note/drum sound progressions tend to be repeated and varied within a song. That allows a competent musician to start playing along a previously-unheard song after listening to it for a while, since they detect a part that they have heard earlier in the song. The jamming assistant 120 is provided to help also less experienced people with this respect.

In order to calculate self-similarity, the received real-time audio signal can be analysed and an internal representation for the played music can be extracted, such as a sequence of feature vectors and/or a sequence of high-level descriptors of the received audio signal.

The feature vectors can be numeric. Each feature vector may represent a short segment of music represented by the audio signal, such as frames of 10 ms to 200 ms of the audio signal. A sequence of successive frames represents longer segments of the received audio signal. The sequence may comprise at least 20, 50, 100, 200, 500, 1 000, 10 000, 20 000, 50 000, 100 000, 200 000, 500 000, 1 000 000, or 2 000 000, frames.

The high-level descriptors comprise, for example, chords, notes, and/or drum sound sounds or notes (in a human readable form).

Let us denote the internal representation by R and to a latest frame by T so that R(T) refers to the internal representation of the latest frame. R(T−1) then refers to the second-latest frame. Let us further assume that a total of N frames are buffered or kept in a memory of the jamming assistant, for example. R(T−N+1) will then refer to an oldest frame that is buffered. N can be chosen to cover the real-time audio signal for a period from half a minute up to several days. The buffer (of frames) is maintained in one embodiment from one music or jamming session to another, possibly regardless whether an apparatus running the method would be shut down or software implementing the method would be closed.

Figure 3:
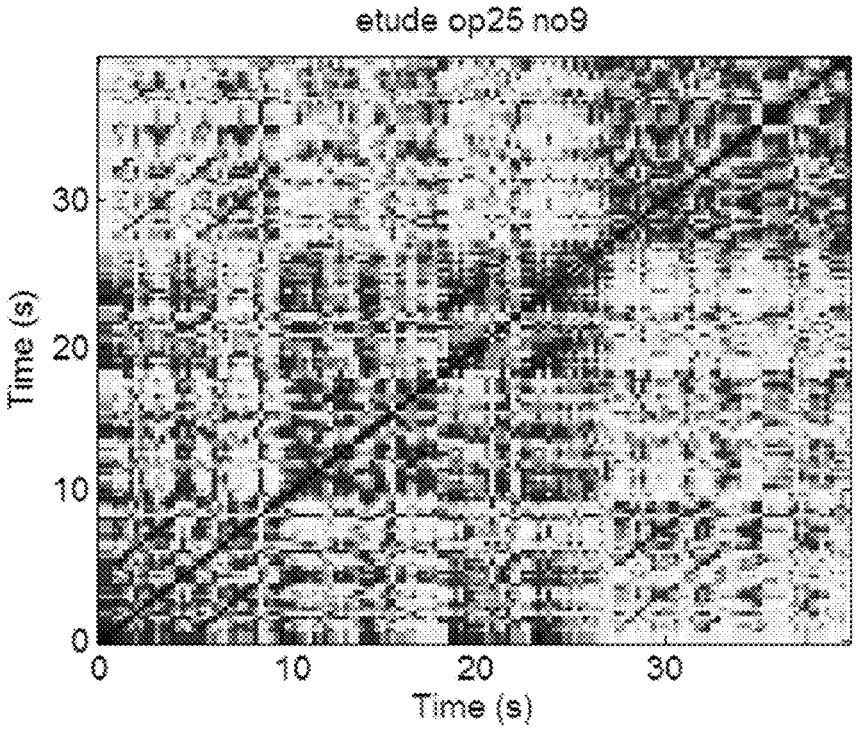
FIG. 3 shows a visualisation of an example of the self-similarity matrix.

In an embodiment, a self-similarity matrix is computed in order to detect repetitions in the played music. FIG. 3 shows a visualisation of an example of the self-similarity matrix. In the visualisation of FIG. 3, the value of each cell is indicated by a point of corresponding shade so that a cell of perfect similarity is black and a cell of perfect dissimilarity is white in the drawing. The matrix describes how well different units (e.g. frames) of a one-dimensional array or vector resemble other units of the same one-dimensional array. About 40 seconds worth of units are illustrated in FIG. 3. In FIG. 3, there is a black diagonal running from the origin (point 0 s, 0 s) to the upper right-hand side corner as on any X-axis point i, the diagonal corresponds to the same Y-axis point and thus to the same unit). The visualisation makes it easy for a human to perceive repetition as dark patterns. For example, a sequence of frames within time interval 1 s to 5 s repeats at 5 s to 9 s and at 28 s to 32 s. The self-similarity matrix is a computational tool that is used in some embodiments in order to detect the repetitions in the played music and predict the next development.

The self-similarity matrix is computed, for example, by comparing a plurality of frames (e.g. every frame) in the memory against a plurality of other frames (e.g. every other frame). When a new frame is formed from the real-time audio signal, the matrix can be updated by comparing the frame against all the previously buffered frames. The matrix can so be formed to contain similarity estimates between all pairs of the buffered frames. The similarity estimates can be calculated using a similarity metric between the internal representations R for the frames being compared. An inverse of the cosine (or Euclidean) distance between feature vectors may be used.

In an embodiment, hashing is used to enable using longer periods of the received audio signal. For example, in the case of extremely long memory lengths N (for example several days), buffering the entire similarity matrix may be undesirable as required buffer size grows proportionally to a square of N. In this embodiment, only the internal representation itself is kept for frames that are older than a certain threshold. For those frames, hashing techniques such as locality sensitive hashing (LSH) is then used to detect a sequence of frames that matches the latest sequence of frames. LSH as a technique differs from the use of the self-similarity matrix, but may serve the same purpose in detecting an earlier sequence of frames that is similar to the latest sequence of frames. Generally, LSH helps to reduce dimensionality of high-dimensional data by hashing input items such that similar items map to the same buckets with high probability. The number of buckets is much smaller than the universe of possible input items, which saves processing cost.

In an embodiment, the detecting of the repetitions in the played music comprises detecting that latest L frames are very similar to a sequence of frames that happened X seconds earlier. That two sequences of frames are very similar (i.e. sufficiently similar for indicating repetition in the played music) can be determined e.g. by comparing their similarity (e.g. inverse of Euclidean distance) to a set threshold. For example, repetition may be detected if the similarity is above a given threshold for the pair of representations R at times T and T−X, for the pair at times T−1 and T−X−1, and so forth until the pair at times T−L and T−X−L. When repetition is detected, the next development in the played music can be predicted for coming frames from current time T onwards.

The user can be allowed to select a desired musical style (such as rock, jazz, or bossa nova for example). The predicting of the next development can then be performed accordingly i.e. based on the selected style.

In step 240, the respective timing based on the estimated time of the next beat need not be limited to defining the time on the next beat. Instead, the next time to play the predicted development may be timed at an offset of some fraction of the time between beats from the next beat. The offset may be anything from k to I beats, wherein k=−1 and I is greater than or equal to 0, for example 0; N/8, N/16, N/32 wherein N is an integer greater or equal to 1. For example, the offset could be 5/8 or 66/16 beats i.e. more than one beats ahead but not necessarily with the same beat division as the base beat. Yet the timing would be based on the next beat.

In an example embodiment, the real-time outputting comprises displaying any one or more of: musical notation such as notes, chords, drum notes and/or activating given fret, instrument key or drum specific indicators. The displaying may be performed using a display screen or projector.

Figure 4:
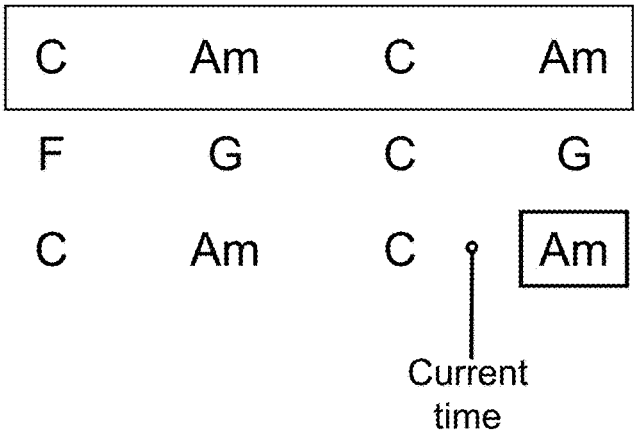
FIG. 4 shows an example visualisation of the next development.

FIG. 4 shows an example visualisation of the next development. The producing of the real-time output includes displaying a timeline with indication of events placed on the timeline such that the timeline comprises several rows on the screen. Current time on the timeline may be indicated to the user and any predicted musical events may be shown on the timeline. The producing of the real-time output with a visualisation may allow an amateur musician to play along with a song even though they would not know the song in advance or would not be able to predict "by ear" what should be played at a next time instant.

In an embodiment, the producing of the real-time output comprise visualising repeating sequences. When the latest L events indicate a repetition of a previously-seen sequence, the previously seen matching sequence(s) can be visually highlighted on the device screen as illustrated in FIG. 4.

A pre-defined library of musical patterns is used in an embodiment to assist in the predicting of the next development in the played music. The library contain, for example, any one or more musical patterns selected from a group consisting of: popular chord progressions; musical rules about note progressions; and popular drum sound patterns. A user can select one or more recorded songs and the recorded songs can then be processed as if previously received in the real-time audio signal. Subsequently, when the user is performing in real time afterwards, the latest sequence of frames can be compared also against the internal representation formed based on the recorded songs and it can be detected if the user is performing one of the recorded songs or playing something sufficiently similar and use that song in the predicting of the next development in the played music. In an embodiment, the musical key of the recorded songs is detected on their processing and the comparison of similarity is performed with a further step of converting the musical key of the recorded songs to match that of the currently played music. In this embodiment, the jamming assistant can propose a next development based on a recorded song that would suit to the played music except for its musical key and so broader selection of useful reference material can be used. Furthermore, the jamming assistant can simplify transposition of the played music to better suit to the singer or singers (e.g. players of the instruments or pure vocalists).

By using recorded songs, it is possible to from learn possible patterns while the user is still allowed to play with rhythm, musical key (free transposition to another key) and style of her own preference freely deviating from those of the recorded songs as in a jamming session with other musicians.

A musical key of the played music can be shown to the user.

In an embodiment, the producing a real-time output may comprise performing one or more instruments along with the played music. For example, the jamming assistant can be configured to produce a corresponding midi-signal to be interpreted and played by a synthesizer with an instrument sound chosen by the user or selected by the jamming assistant (e.g. based on the recorded songs or pre-set rules, e.g. base or drums are less universally transportable from one instrument to another than e.g. flute, piano and violin).

FIG. 5 shows a block diagram of a jamming assistant 120 according to an embodiment of the invention. The jamming assistant 120 comprises a memory 510 including a persistent memory 512 configured to store computer program code 514 and long-term data 516 such as similarity matrix, recorded songs and user preferences. The jamming assistant 120 further comprises a processor 520 for controlling the operation of the jamming assistant 120 using the computer program code 514, a work memory 518 for running the computer program code 514 by the processor 520, a communication unit 530, a user interface 540 and a built-in microphone 122 or plurality of microphones. The communication 530 unit may comprise inputs 532 for receiving signals from external microphone(s) 130, instrument inputs 534 e.g. for receiving MIDI-signals or guitar signals, audio outputs 536, and digital outputs 538 (e.g. MIDI, LAN, WLAN). The processor 520 is e.g. a microprocessor, a digital signal processor (DSP), an application specific integrated circuit (ASIC), a microcontroller or a combination of such elements. The user interface 540 comprises e.g. a display 542, one or more keys 544, and/or a touch screen 546 for receiving input, and/or a speech recognition unit 548 for receiving spoken commands from the user.

Various embodiments have been presented. It should be appreciated that in this document, words comprise, include and contain are each used as open-ended expressions with no intended exclusivity.

The foregoing description has provided by way of non-limiting examples of particular implementations and embodiments of the present disclosure a full and informative description of the best mode presently contemplated by the inventors for carrying out the disclosed embodiments. It is however clear to a person skilled in the art that the present disclosure is not restricted to details of the embodiments presented in the foregoing, but that it can be implemented in other embodiments using equivalent means or in different combinations of embodiments without deviating from the characteristics of the present disclosure.

Furthermore, some of the features of the afore-disclosed embodiments of the present disclosure may be used to advantage without the corresponding use of other features. As such, the foregoing description shall be considered as merely illustrative of the principles of the present disclosure, and not in limitation thereof. Hence, the scope of the present disclosure is only restricted by the appended patent claims.

The invention claimed is:

1. A method comprising:

automatically receiving a real-time audio signal of played music that is played by at least one person;

automatically tracking beat of the played music from the real-time audio signal and accordingly automatically predicting a time of a next beat;

automatically recognising from the real-time audio signal at least one of chords; notes; and drum sounds and accordingly automatically detecting repetitions in the played music;

automatically predicting a next development in the played music, based on the detected repetitions, comprising at least one of chords; notes; and drum sounds that will be played next, and respective timing based on the predicted time of the next beat; and automatically producing a real-time output based on the predicted next development in the played music wherein:

the predicting of the at least one of chords; notes; and drum sounds is performed by detecting self-similarity in the played music; and the user is allowed to select a desired musical style and the predicting of the next development is performed accordingly.

2. The method of claim 1, wherein a pre-defined library of musical patterns is used to assist in the predicting of the next development in the played music.

3. The method of claim 2, wherein the library contains any one or more musical patterns selected from a group consisting of: popular chord progressions; musical rules about note progressions; and popular drum sound patterns.

4. A method comprising:

automatically receiving a real-time audio signal of played music that is played by at least one person;

automatically tracking beat of the played music from the real-time audio signal and accordingly automatically predicting a time of a next beat;

automatically recognising from the real-time audio signal at least one of chords; notes; and drum sounds and accordingly automatically detecting repetitions in the played music;

automatically predicting a next development in the played music, based on the detected repetitions, comprising at least one of chords; notes; and drum sounds that will be played next, and respective timing based on the predicted time of the next beat; and automatically producing a real-time output based on the predicted next development in the played music;

wherein the predicting of the at least one of the chords; notes; and drum sounds is performed by detecting self-similarity in the played music;

the method further comprising:

computing a self-similarity matrix;

updating the matrix by comparing the frame against all the previously buffered frames when a new frame is formed from the real-time audio signal.

5. A method comprising:

automatically receiving a real-time audio signal of played music that is played by at least one person;

automatically tracking beat of the played music from the real-time audio signal and accordingly automatically predicting a time of a next beat;

automatically recognising from the real-time audio signal at least one of chords; notes; and drum sounds and accordingly automatically detecting repetitions in the played music;

automatically predicting a next development in the played music, based on the detected repetitions, comprising at least one of chords; notes; and drum sounds that will be played next, and respective timing based on the predicted time of the next beat; and automatically producing a real-time output based on the predicted next development in the played music; wherein:

the predicting of the at least one of chords; notes; and drum sounds in performed by detecting self-similarity in the played music; wherein hashing is used to enable using longer periods of the received audio signal; and locality sensitive hashing (LSH) is used to detect a sequence of past frames of the received audio signal that matches the latest sequence of frames.

6. The method of claim 5, wherein the tracking of the beat of the played music from the real-time audio signal adapts to fluctuation of the tempo of the played music.

7. The method of claim 5, wherein:

the self-similarity is calculated using analysing of the received real-time audio signal so as to extract an internal representation for the played music; and the internal representation comprises:

a sequence of feature vectors that represent the musical contents of a short segments of received audio signal; or a sequence of high-level descriptors of the received audio signal, wherein the high-level descriptors comprise any one or more of chords; notes; and drum sound notes.

8. The method of claim 5, wherein the producing of the real-time output comprises displaying any one or more of: musical notation; chords; drum notes; given fret indication; an instrument key indication; and a drum specific indication.

9. The method of claim 5, wherein the producing of the real-time output comprises displaying a timeline with indication of events placed on the timeline such that the timeline comprises several rows on the screen.

10. The method of claim 5, wherein the producing of the real-time output comprises visualising repeating sequences.

11. The method of claim 5, wherein the user is allowed to select one or more recorded songs and the recorded songs are processed as if previously received in the real-time audio signal.

12. The method of claim 5, wherein the producing of the real-time output comprises performing one or more instruments along with the played music.

13. A non-transitory memory medium comprising computer executable program code which when executed by at least one processor causes an apparatus at least to perform the method of claim 1.

14. A method comprising:

automatically receiving a real-time audio signal of played music that is played by at least one person;

automatically tracking beat of the played music from the real-time audio signal and accordingly automatically predicting a time of a next beat;

automatically recognising from the real-time audio signal at least one of chords; notes; and drum sounds and accordingly automatically detecting repetitions in the played music;

automatically predicting a next development in the played music, based on the detected repetitions, comprising at least one of chords; notes; and drum sounds that will be played next, and respective timing based on the predicted time of the next beat; and automatically producing a real-time output based on the predicted next development in the played music wherein:

the predicting of the at least one of chords; notes; and drum sounds is performed by detecting self-similarity in the played music; and a musical key of the played music is shown to the user.

15. A non-transitory memory medium comprising computer executable program code which when executed by at least one processor causes an apparatus at least to perform the method of claim 14.

16. An apparatus comprising a processor and computer program code configured to cause the apparatus to automatically perform, on executing by the processor of the computer program code:

receiving a real-time audio signal of played music that is played by at least one person;

tracking beat of the played music from the real-time audio signal and accordingly predicting a time of next beat;

recognising from the real-time audio signal at least one of chords; notes; and drum sounds and accordingly detecting repetitions in the played music;

predicting a next development in the played music, based on the detected repetitions, comprising at least one of chords; notes; and drum sounds that will be played next, and respective timing based on the predicted time of the next beat; and producing a real-time output based on the predicted next development in the played music;

wherein the processor and computer program code are configured to cause the apparatus to perform, on executing by the processor;

the predicting of the at least one of: chords; notes; and drum sounds by detecting self-similarity in the played music; and allowing the user to select a desired musical style and performing accordingly the predicting of the next development.

17. The apparatus of claim 16, wherein the processor and computer program code are configured to cause the apparatus to perform, on executing by the processor, the tracking of the beat of the played music from the real-time audio signal adapting to fluctuation of the tempo of the played music.

18. An apparatus comprising a processor and computer program code configured to cause the apparatus to automatically perform, on executing by the processor of the computer program code:

receiving a real-time audio signal of played music that is played by at least one person;

tracking beat of the played music from the real-time audio signal and accordingly predicting a time of next beat;

recognising from the real-time audio signal at least one of chords; notes; and drum sounds and accordingly detecting repetitions in the played music;

predicting a next development in the played music, based on the detected repetitions, comprising at least one of chords; notes; and drum sounds that will be played next, and respective timing based on the predicted time of the next beat; and producing a real-time output based on the predicted next development in the played music;

wherein the processor and computer program code are further configured to cause the apparatus to:

perform the predicting of the at least one of chords; notes; and drum sounds by detecting self-similarity in the played music; and show a musical key of the played music to the user.

* * * * *